US005122196A

United States Patent [19]

Fernandez

[11] Patent Number: 5,122,196

[45] Date of Patent: Jun. 16, 1992

[54] SUPERPLASTIC SHEET METAL MADE FROM AN ALUMINUM ALLOY

[75] Inventor: Philippe Fernandez, Neuhausen am Rheinfall, Switzerland

[73] Assignee: Alusuisse-Lonza Services Ltd., Zurich, Switzerland

[21] Appl. No.: 710,056

[22] Filed: Jun. 4, 1991

[30] Foreign Application Priority Data

Jun. 11, 1990 [CH] Switzerland ..... 1959/90

[51] Int. Cl.[5] ..... C22F 1/04

[52] U.S. Cl. ..... 148/552; 148/437; 148/438; 148/439; 148/440; 148/692; 420/541; 420/902

[58] Field of Search ..... 148/2, 11.5 A, 12.7 A, 148/159, 415–417, 437–440; 420/532, 541, 902

[56] References Cited

U.S. PATENT DOCUMENTS

| | | | |
|---|---|---|---|
| 3,984,260 | 10/1976 | Watts et al. | 148/2 |
| 4,021,271 | 5/1977 | Roberts | 148/2 |
| 4,867,805 | 9/1989 | Agrawal et al. | 148/11.5 A |
| 4,874,578 | 10/1989 | Homberger et al. | 420/541 |

FOREIGN PATENT DOCUMENTS

| | | |
|---|---|---|
| 0084571 | 8/1983 | European Pat. Off. . |
| 0297035 | 12/1988 | European Pat. Off. . |
| 60-86248 | 5/1985 | Japan . |
| 60-251260 | 12/1985 | Japan . |

*Primary Examiner*—R. Dean
*Assistant Examiner*—Robert R. Koehler
*Attorney, Agent, or Firm*—Bachman & LaPointe

[57] ABSTRACT

The sheet metal which has recrystallized as fine grains and has superplastic characteristics consists of a work-hardenable, age-hardenable AlMgZn alloy. After continuous casting, the alloy containing 3–5.5% of magnesium, 2–8% of zinc, 0.4% of copper, 0–1% of manganese, 0–0.5% of iron, 0–0.4% of chromium, 0–0.4% of molybdenum, 0–0.4% of zirconium, 0–0.3% of silicon and 0–0.05% of titanium, the remainder being aluminium of commercial purity, is homogenized and rolled off hot. After an optional intermediate annealing, the strip is rolled off cold to the final thickness using a high degree of cold rolling, recrystallized, using rapid heating to effect softening, and cooled.

18 Claims, No Drawings

SUPERPLASTIC SHEET METAL MADE FROM AN ALUMINUM ALLOY

BACKGROUND OF THE INVENTION

The invention relates to a process for the production of a sheet metal which has recrystallized as fine grains and is suitable for superplastic forming from a work-hardenable, age-hardenable aluminum alloy.

In the case of age-hardenable aluminum alloys, an increase in strength can also be achieved by heat treatment as well as by cold forming. These alloys, for example of the AlZnMg and AlZnMgCu type, tend to grain formation if the solution annealing necessary for precipitation hardening is associated with a recrystallization. However, for numerous applications, in particular for superplastic forming, a fine-grained character is desirable or a prerequisite. In the case of sheet metal, for example, which is to be subjected to superplastic forming, the grain size is below 25 μm and preferably below 10 μm. In addition, the grains should be in virtually globulitic form. Moreover, the substantial increase in size of the regularly distributed grains or sub-grains must also not take place during superplastic forming, which is carried out at or just above 500° C.

The plastic extension of a superplastic aluminum alloy is usually in the range of 400–800%, that is to say far above the values for conventional alloys. This allows multiple possibilities for shaping in respect of function and design with economic production from one piece. The variety, of shapes are reproducible with high dimensional accuracy; no "spring-back" occurs. The simple tools which can be used and which permit even small and medium production runs at favorable costs and can be produced with short delivery times are turned to particular advantage. Changes in shape can be carried out rapidly at acceptable cost.

Numerous binary and ternary aluminum alloys having superplastic characteristics have been described, in particular also of the AlMg type, for example in EP,A1 0297035.

SUMMARY OF THE INVENTION

The object on which the present invention is based is to provide a process which permits the production, at reasonable cost, of an aluminum sheet metal which has superplastic characteristics, can also be cooled in air and is agehardenable and not susceptible to corrosion.

The object is achieved, according to the invention, in that, after continuous casting, an alloy containing 3–5.5% of magnesium, 2–8% of zinc, 0–4% of copper, 0–1% of manganese, 0–0.5% of iron, 0–0.4% of chromium, 0–0.4% of molybdenum, 0–0.4% of zirconium, 0–0.3% of silicon and 0–0.05% of titanium, the remainder being aluminum of commercial purity, is homogenized, rolled off hot, rolled off cold with a high degree of cold rolling to the final thickness and, in a final heat treatment with rapid heating, annealed to produce recrystallization and cooled.

DETAILED DESCRIPTION

A suitable work-hardenable, age-hardenable AlMgZn alloy is, in particular, an alloy containing 4–5% of magnesium and 2–6%, preferably 3–4% of zinc. Here and elsewhere the percentage data are always given in percent by weight.

The preferred proportions for the other alloy components are 0–0.1% of copper, 0.2–0.4% of manganese, 0.15–0.25% of chromium, 0–0.2% of iron, 0–0.2% of molybdenum, 0–0.1% of zirconium and 0–0.1% of silicon, it also being possible, however, for the chromium content to be 0–0.1% and, at the same time, the zirconium content to be 0.15–0.25%.

The very low iron content compared with EP-,A1,0297035 is worthy of note.

The use of two particular types of alloy, which fall within the scope of the invention, has been successfully tested.

An aluminum alloy containing 4–5% of magnesium, 3–4% of zinc, 0.4–0.6% of copper, 0.6–0.8% of manganese, 0.1–0.15% of iron, 0.1–0.2% of zirconium and 0.05–0.1% of silicon.

An aluminum alloy containing 4.1–4.5% of magnesium, 3.5–3.7% of zinc, 0.2–0.4% of manganese, 0.05–0.15% of iron, 0.1–0.3% of zirconium and 0.05–0.1% of silicon.

The continuously cast blocks of the aluminum alloy are freed from the casting skin and cut into lengths. These lengths can, in a first homogenization step, be heated to a metal temperature of 420°–450° C. in the course of 2–12 hours and kept at this temperature for 4–12 hours and, in a second homogenization step, be heated to 480°–530° C. in the course of 0.5–4 hours and kept at this temperature for 2–12 hours.

Instead of a two-step homogenization annealing, however, the lengths can be heated to a metal temperature of 420°–480° C. in the course of 4–12 hours and kept at this temperature for 10–30 hours in a stepless homogenization.

Hot rolling is appropriately carried out immediately following the homogenization annealing or after cooling and reheating to 350°–500° C. The homogenized lengths are rolled off in several passes to give a 4–30 mm strip and in particular to about 6–10 mm. At the end of hot rolling, the metal temperature is preferably between 325° and 345° C.

Preferably, the hot-rolled strip is subjected to intermediate annealing for 6–36 hours at 300°–400° C. before cold rolling.

The hot-rolled strip, which is age-hardenable because of the alloy composition, is additionally hardened by cold working, by rolling off, preferably with a degree of cold working of 60–95% and in particular 70–90%. The final thickness is, for example, between 1.5 and 3 mm and in particular about 2 mm.

The homogenization annealing serves to reduce the structural irregularities, such as segregation and precipitation, which are formed during casting of rolled ingots. The mechanical strength increases and the 0.2% offset yield stress, tensile strength and hardness increase as a result of cold working. The recrystallization of the cold-rolled strip serves for extensive softening and is accompanied by a complete recrystallization of the aluminum alloy.

In addition to the high degree of cold rolling, rapid heating, which preferably takes place in a salt bath at 490°–510° C. or in a strip furnace at a corresponding temperature, is of essential importance. The recrystallization annealing should be carried out using a heat-up time of at most 8 minutes and in particular of at most 3 minutes, depending on the alloy composition and the nature of the cold-rolled strip. The softened strips are cooled in air or in water.

The softened aluminum strips have superplastic characteristics. In addition to the high extensibility coupled with relatively high mechanical strength, they are distinguished in particular by their exceptionally low susceptibility to corrosion, also in respect of stress corrosion.

Depending on the specific application, yet further characteristics, such as low density, anodizability, coatability, hygiene, dimensional stability, electrical and thermal conductivity and/or antistatic properties have an advantageous effect.

The process according to the invention is illustrated in more detail with the aid of the following illustrative embodiments.

EXAMPLE 1

An aluminum alloy containing 4.4% of magnesium, 3.7% of zinc, 0.5% of copper, 0.7% of manganese, 0.12% of iron, 0.19% of zirconium and 0.07% of silicon is cast by the vertical continuous casting process using electromagnetic ingot moulds to give ingots 70×200×800 mm in size, using the customary $TiB_2$ grain refining technique. The casting temperature is approximately 720° C. After casting, the casting skin is removed, the top and bottom of the ingot are separated off and the ingot is divided into portions. In a first homogenization step these are heated to 440° C. in the course of 3 hours and kept at this temperature for 8 hours and in a second homogenization step they are heated to 500° C. in the course of 1 hour and kept at this temperature for 3 hours.

Immediately after the homogenization, the ingots are rolled off to 9 mm in several passes, the final temperature of the metal being between 325° and 345° C.

The cold rolling is carried out with a degree of cold forming of about 78% to 2 mm. The recrystallization annealing is carried out using a heat-up time of 5 minutes in a liquid mixture of potassium nitrate and sodium nitrate at 500° C. After cooling in water, the strips are cleaned and dried.

EXAMPLE 2

An aluminum alloy containing 4.3% of magnesium, 3.6% of zinc, 0.3% of manganese, 0.11% of iron, 0.20% of zirconium and 0.07% of silicon is employed in a process corresponding to Example 1, for the production of a sheet metal which has recrystallized as fine grains and is suitable for superplastic forming.

The metal sheets from both examples display superplastic characteristics; their extension is checked at 500° C., 520° C. and 540° C.

Metallographic examination shows finely divided, globulitic grains less than 10 μm in size which are regularly distributed.

I claim:

1. Process for the production of a sheet metal which has recrystallized as fine grains and is suitable for superplastic forming from a work-hardenable, age-hardenable aluminum alloy, which comprises: continuous casting an aluminum alloy based on commercial purity aluminum containing 3–5.5% of magnesium, 2–8% of zinc, up to 4% of copper, up to 1% of manganese, up to 0.5% of iron, up to 0.4% of chromium, up to 0.4% of molybdenum, up to 0.4% of zirconium, up to 0.3% of silicon and up to 0.05% of titanium; homogenizing; hot rolling; cold rolling with a high degree of cold rolling to final thickness; and, in a final heat treatment with rapid heating, annealed to produce recrystallization; and cooled.

2. Process according to claim 1 wherein an aluminum alloy containing 4–5% of magnesium and 2–6% of zinc is used.

3. Process according to claim 1 wherein an aluminum alloy containing 4–5% of magnesium and 3–4% of zinc is used.

4. Process according to claim 1 wherein an aluminum alloy containing up to 0.1% of copper, 0.2–0.4% of manganese, 0.15–0.25% of chromium, up to 0.2% of iron, up to 0.2% of molybdenum, up to 0.1% of zirconium and up to 0.1% of silicon is used.

5. Process according to claim 1 wherein an aluminum alloy containing up to 0.1% of copper, 0.2–0.4% of manganese, up to 0.1% of chromium, up to 0.2% of iron, up to 0.2% of molybdenum, 0.15–0.25% of zirconium and up to 0.1% of silicon is used.

6. Process according to claim 1 wherein an aluminum alloy containing 4–5% of manganese, 3–4% of zinc, 0.4–0.6% of copper, 0.6–0.8% of manganese, 0.1–0.15% of iron, 0.1–0.3% of zirconium and 0.05–0.1% of silicon is used.

7. Process according to claim 1 wherein an aluminum alloy containing 4.1–4.5% of magnesium , 3.5–3.7% of zinc, 0.2–0.4% of manganese, 0.05–0.15% of iron, 0.1–0.3% of chromium and 0.05–0.1% of silicon is used.

8. Process according to claim 1 wherein: the aluminum alloy is a first homogenization step, is heated to a metal temperature of 420°–450° C. in the course of 2–12 hours and kept at this temperature for 4–12 hours; and, in a second homogenization step, is heated to 480°–530° C. in the course of 0.5–4 hours and kept at this temperature for 2–12 hours.

9. Process according to claim 1 wherein the aluminum alloy is heated to a metal temperature of 420°–480° C. in the course of 4–12 hours and kept at this temperature for 10–30 hours in a stepless homogenization.

10. Process according to claim 1 wherein the hot rolling carried out immediately following the homogenization annealing or after cooling and reheating to 350°–500° C., results in a 4–30 mm, thick strip.

11. Process according to claim 10 wherein the resultant strip is 6–10 mm thick.

12. Process according to claim 1 wherein the hot-rolled strip is subjected to intermediate annealing for 6–36 hours at 300°–400° C. before cold rolling.

13. Process according to claim 1 wherein the hot-rolled strip is rolled off cold with a degree of working of 60–95%.

14. Process according to claim 13 wherein the degree of working is 70–90%.

15. Process according to claim 1 wherein for recrystallization the cold-rolled strip is annealed, using a heat-up time of at most 8 minutes at a temperature of 400°–540° C.

16. Process according to claim 15 wherein the heat-up time is at most 3 minutes.

17. Process according to claim 15 wherein the cold-rolled strip is recrystallized in a salt bath or in a strip furnace.

18. Process according to claim 1 wherein said alloy contains at least 4% magnesium.

* * * * *

UNITED STATES PATENT AND TRADEMARK OFFICE

CERTIFICATE OF CORRECTION

PATENT NO. : 5,122,196

DATED : June 16, 1992

INVENTOR(S) : PHILIPPE FERNANDEZ

It is certified that error appears in the above-identified patent and that said Letters Patent is hereby corrected as shown below:

In Column 4, claim 6, line 20, delete "manganese" and insert --magnesium--.

In Column 4, claim 8, line 29, after "alloy" delete "is" and insert --, in--.

Signed and Sealed this

Seventeenth Day of August, 1993

*Attest:*

*Attesting Officer*

BRUCE LEHMAN

*Commissioner of Patents and Trademarks*